US005273133A

United States Patent [19]

Thocher et al.

[11] Patent Number: 5,273,133

[45] Date of Patent: Dec. 28, 1993

[54] LADDER LEVELER

[75] Inventors: Quinton F. Thocher; Rodney C. Kurzer; Raymond D. Tracy, all of Hart, Mich.

[73] Assignee: Jershon, Inc., Hart, Mich.

[21] Appl. No.: 838,596

[22] Filed: Feb. 19, 1992

[51] Int. Cl.[5] ..... E06C 7/44

[52] U.S. Cl. ..... 182/202; 248/188.3

[58] Field of Search ..... 182/200–205; 248/188.3

[56] References Cited

U.S. PATENT DOCUMENTS

| | | | |
|---|---|---|---|
| 2,458,076 | 1/1948 | Houston | 182/205 |
| 2,894,670 | 7/1959 | Anderson | 228/63 |
| 2,936,849 | 5/1960 | Carson | 182/204 |
| 3,027,969 | 4/1962 | Erickson | 182/202 |
| 3,233,702 | 2/1966 | Feltrop | 182/202 |
| 4,128,139 | 12/1978 | Cook, Sr. | 182/202 |
| 4,627,516 | 12/1986 | Studer | 182/202 |

FOREIGN PATENT DOCUMENTS 342693 8/1936 Italy .

*Primary Examiner*—Alvin C. Chin-Shue

*Attorney, Agent, or Firm*—Price, Heneveld, Cooper, DeWitt & Litton

[57] ABSTRACT

A ladder leveler attachment formed of two preassembled leg assemblies, each having protruding bolts for direct and easy attachment to the ladder side rails, and a drive rod slidably engaging both assemblies. Each assembly has an elongated housing and an elongated, slidably interfitting base plate, the two components forming pockets for retaining protruding attachment bolts. Inside each housing is a gear, and a gear rack having closed ends forming gear stops. Swivel feet are detachably secured to hoop feet, being shiftable from a lowered, generally horizontal position to a vertical, edge-engaging position alongside the leg housing.

20 Claims, 4 Drawing Sheets

LADDER LEVELER

BACKGROUND OF THE INVENTION

This invention relates to leveling devices to be attached to ladders for causing the ladder to adjust to and maintain a true vertical relationship rather than tilt laterally.

In 1959, Anderson and Studer were granted U.S. Pat. No. 2,894,670 for a ladder attachment to be mounted on a ladder by the purchaser, for self-leveling of the ladder. The attachment discloses the use of gear racks, gears, and gear locks, all in an extension at the bottom of the two ladder side rails or legs. Although this attachment device had advantages, it was, as admitted by Studer in his later U.S. Pat. No. 4,627,516, "relatively bulky and difficult for the average homeowner to install with sufficient confidence that the leveling attachment will work in the manner intended with the required safety." Furthermore, as explained by Studer, "the self-leveling attachment of my earlier invention required a considerable number of specially designed component parts which increased the weight and cost of the attachment, making it less attractive for purchase by the average home user desiring a self-leveling ladder." This prior '670 attachment of Studer and Anderson had to be assembled as it was mounted onto the ladder.

As a consequence of these problems, Studer developed a self-leveling mechanism formed as an actual part of the ladder, i.e., an integral ladder mechanism, so that, "the self-leveling mechanism is incorporated into the ladder at the factory," as set forth in the '516 patent. Because it was made at the factory, the buyer did not have to assemble/mount it on the ladder.

However, there are many thousands of ladders already owned by homeowners, repairmen, businesses, etc., which could beneficially use a ladder leveling attachment if it did not have the disadvantages of the previous attachment unit. Since such ladders are already manufactured, it is too late for a leveling attachment to be mounted at the factory. Moreover, many buyers of ladders do not realize they need a leveler until after a new ladder is purchased and used.

SUMMARY OF THE INVENTION

An object of this invention is to provide a novel, simpler ladder leveling attachment which can be readily mounted by a homeowner, businessman or serviceman to an existing ladder. The novel attachment has leg units which are basically preassembled at the factory. These leg units are directly, simply and readily bolted in place on opposite rails of an existing ladder by the ultimate purchaser, to be ready for use. Each leg unit of the leveler has an easy mounting structure, a specially configurated base plate, positive gear stop features at the end of each gear rack, a special hoop foot configuration, a uniquely shaped swivel foot allowing it to pivot up on a side edge of the attachment, a simple drive rod of polygonal cross sectional configuration for slidably engaging the gears of the preassembled leg units, and other features, objects and advantages which will become apparent upon studying the following detailed specification in conjunction with the drawings.

DESCRIPTION OF THE PREFERRED EMBODIMENT

Figure 1:
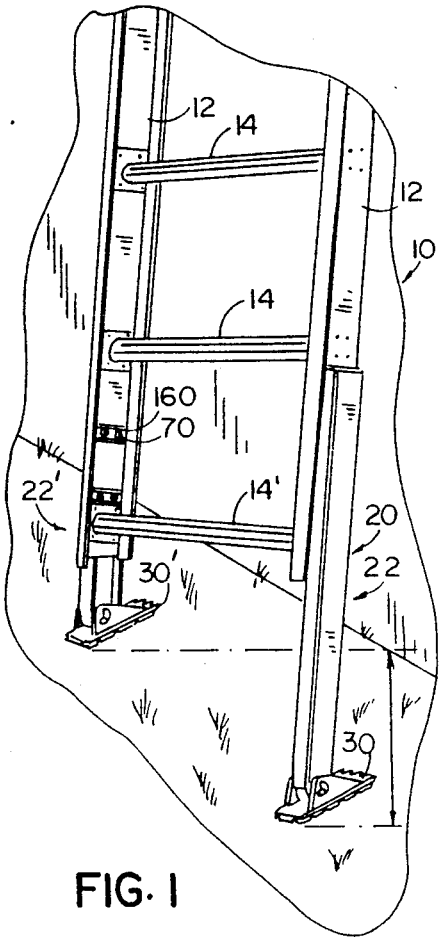
FIG. 1 is a perspective, elevational, fragmentary view of the novel attachment shown attached to a ladder and positioned on a slope.
Figure 2:
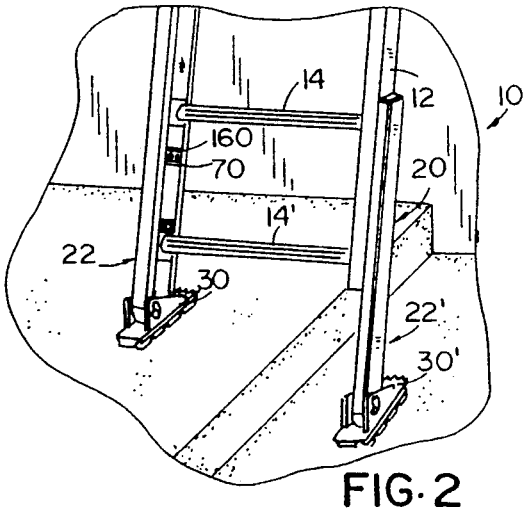
FIG. 2 is a perspective view of the attachment mounted on a ladder and positioned on steps.
Figure 3:
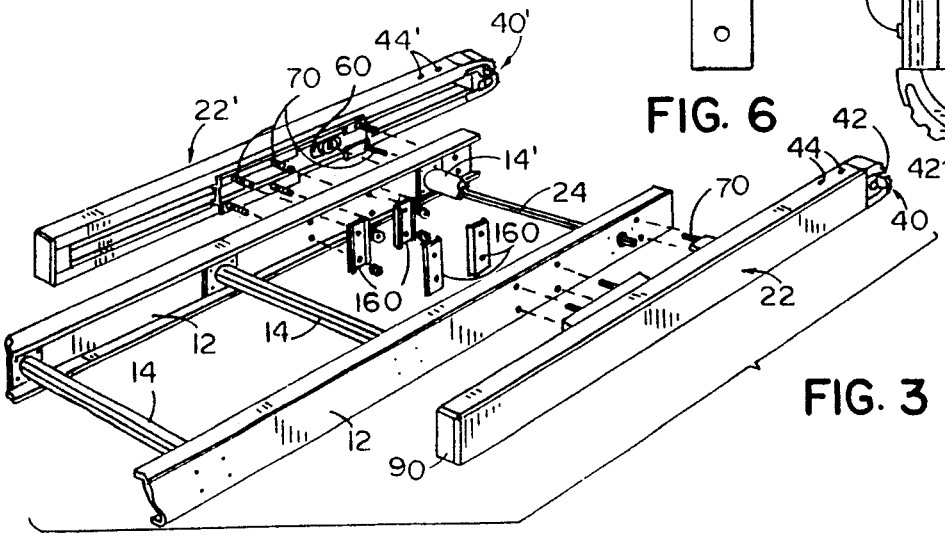
FIG. 3 is a perspective, exploded view of the attachment relative to a ladder.
Figure 9:
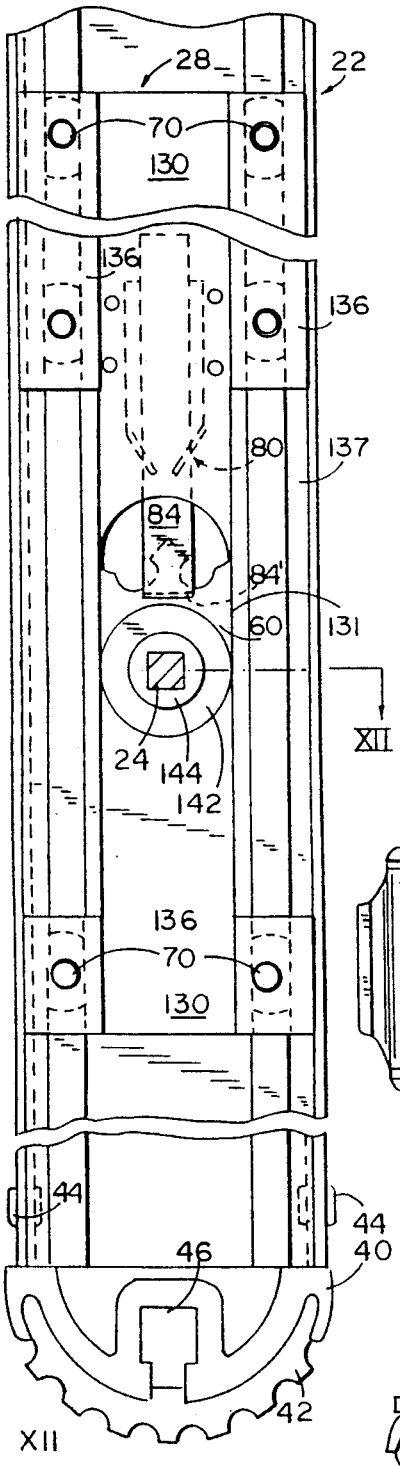
FIG. 9 is an enlarged, fragmentary, elevational view of the leg assembly.

Referring now specifically to the drawings, FIGS. 1 and 2 show a ladder 10 normally of metal such as aluminum, or of fiberglass reinforced polymer, and having a pair of vertical side rails 12 and a plurality of rungs 14 mounted therebetween in conventional fashion. Attached to the ladder 10 is the novel leveler attachment 20 composed of like leg assemblies 22, each attached to the outside face of one of the respective rails 12 and drivingly interconnected by a drive rod 24 (FIGS. 3 and 9). These rungs of the ladder, if made of metal, are typically hollow, with the drive rod extending through the bottom rung 14' of ladder 10. If the ladder is wood, drive rod 24 would be positioned immediately beneath the bottom rung, preferably extending through a hollow tube mounted to the ladder between the side rails.

Each leg assembly 22 is preassembled at the production center, i.e., the factory, so that all the user need do in order to employ the structure is to attach each of the two leg assemblies to the opposite rails of the ladder, interconnected by the drive rod 24.

Figure 5:
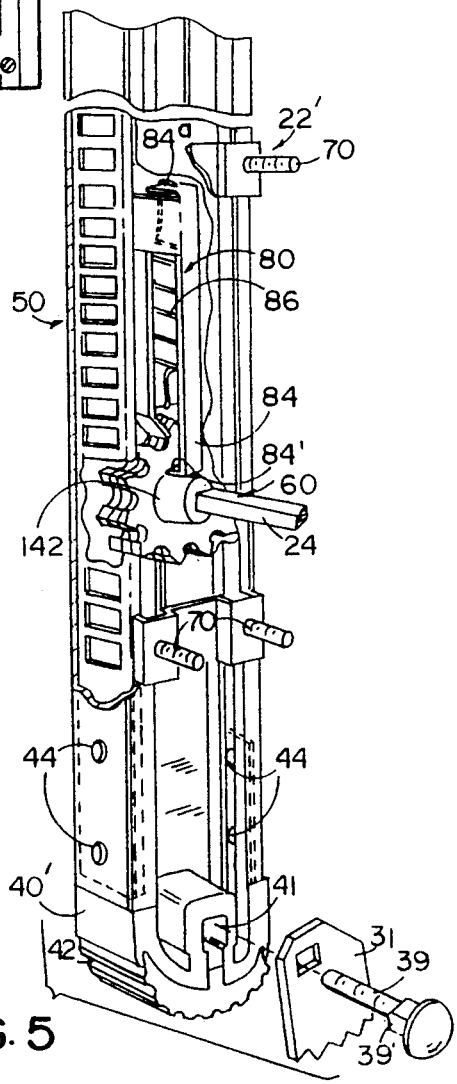
FIG. 5 is a fragmentary, perspective view of a portion of the leg assembly in FIG. 4, also showing a spur exploded away from the hoop foot to which it attaches.
Figure 7:
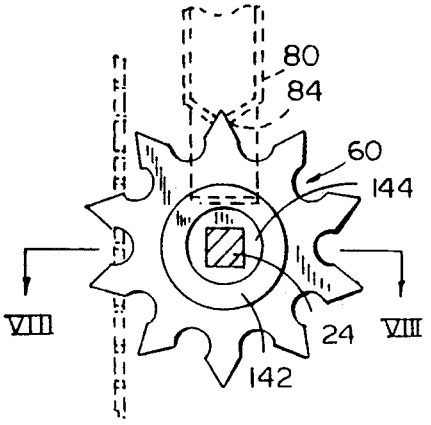
FIG. 7 is an elevational, fragmentary view, partially in phantom, of the gear, gear rack and gear lock of one of the leg assemblies.

In FIGS. 1 and 2, attachment 20 is shown to include a pair of swivel feet 30 and 30' on respective leg assemblies 22 and 22'. These swivel feet can be removably mounted to special hoop feet 40 and 40' shown in FIGS. 3, 4 and 5, as explained further hereinafter.

Figure 17:
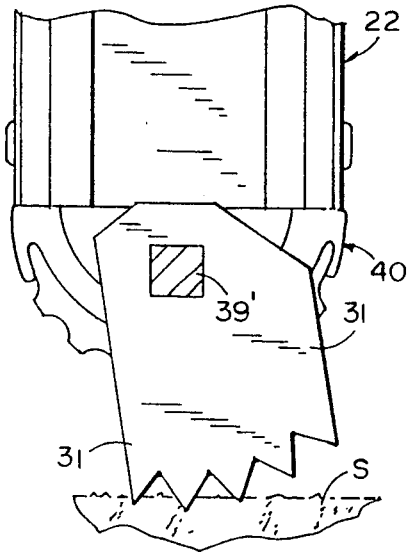
FIG. 17 is an enlarged, fragmentary, side elevational view of the bottom of one extension leg and hoop foot, showing a spur attached thereto.
Figure 19:
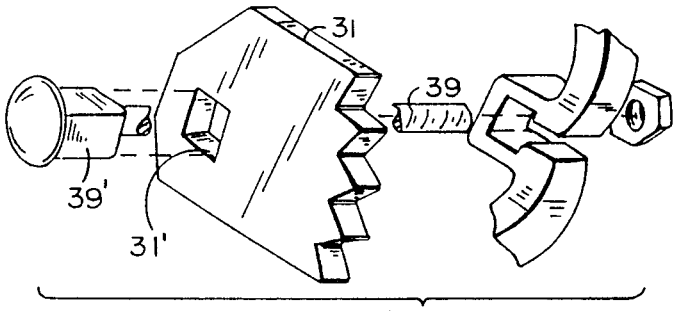
FIG. 19 is an exploded, enlarged, perspective view of the spur and hoop foot in FIG. 17.
Figure 20:
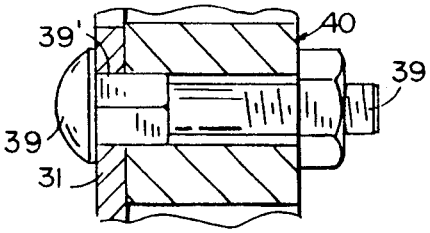
FIG. 20 is an enlarged, sectional, fragmentary view through the hoop foot, showing the spur mount.

Each of the hoop feet 40 preferably comprises a segment of an elongated aluminum extrusion, configurated to have a convex bottom surface to which a polymeric, e.g., rubber, grip or pad 42 is attached as by rivets (not shown) so as to also convexly curve. The hoop foot also includes a pair of upstanding protrusions which extend up a few inches into the elongated metal housing 26 of the attachment leg assembly and are secured thereto by rivets 44. Each hoop foot is specially configurated to include a transverse passageway 46 of polygonal cross sectional configuration, and through which a fastener pin or carriage bolt 39 (FIG. 2) may extend. This arrangement allows easy attachment of the swivel feet 30 (FIGS. 1, 2, 14 and 18), or of a spur 31 (FIGS. 5, 17, 19 and 29), when desired. Carriage bolt 39 has a conventional polygonal cross sectional portion 39' near the head of the bolt, which interfits with the polygonal opening 46 in the hoop foot and the polygonal opening 33' in spur 31, to fix the spur against rotation when mounted to the extension foot. The downwardly projecting teeth of spur 31 can therefore dig into ice or the like on support surface S (FIG. 17) to fix the lower end of the ladder extension. This uniquely configurated hoop foot enables attachability of a spur or swivel foot in simple fashion, in sharp contrast to prior art equipment which required specialized separate attachment components.

Figure 15:
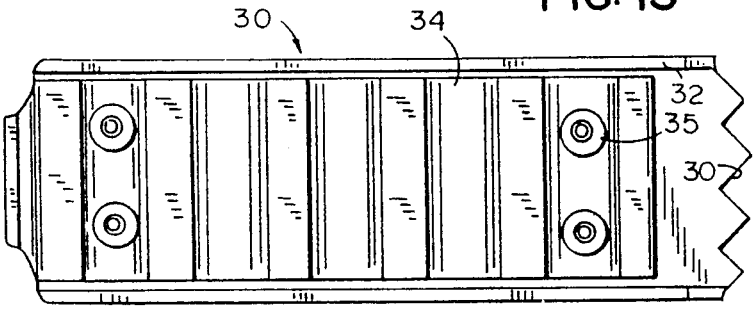
FIG. 15 is a bottom plan view of the swivel foot in FIG. 14.
Figure 14:
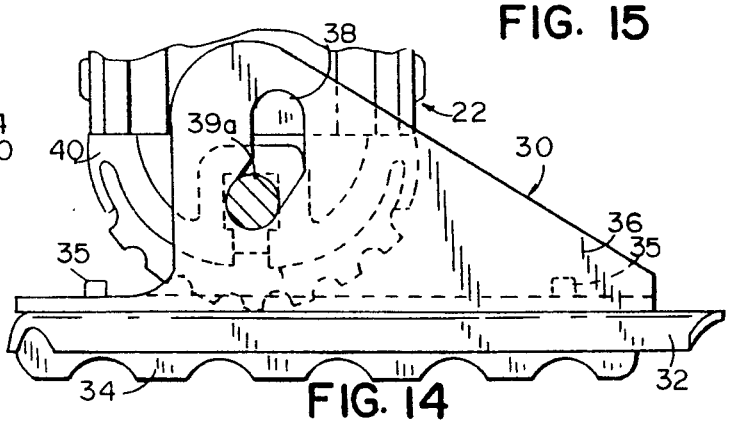
FIG. 14 is an elevational view of a swivel foot for the assembly shown attached to the hoop foot.
Figure 18:
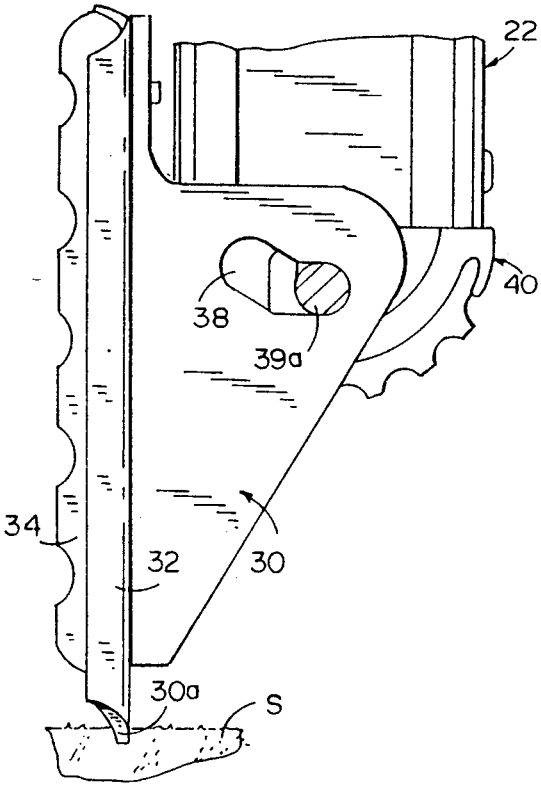
FIG. 18 is an enlarged, fragmentary, side elevational view of the bottom of one extension leg, showing a swivel foot attached thereto and in the upright position.

Each swivel foot 30 (FIG. 14) includes an elongated generally planar lower shoe 32 which receives and secures an underlying polymeric, e.g., rubber grip pad 34, attached to the shoe as by rivets 35 (FIG. 15). Each swivel foot also has a pair of upstanding, parallel, spaced flanges 36 to straddle a hoop foot 40. These flanges 36 each include a pair of aligned, elongated, preferably dogleg-shaped, slots 38 for receiving the fastener pins or bolts **39*a* (FIG. 14) therethrough, to mount the swivel feet to the hoop feet 40. The bolt extends through opening 41. These swivel feet 30 can be readily attached to or removed from the ladder extension. When attached, they can swivel about the mounting bolts to assume the horizontal lowered position in fully aligned engagement with the support surface, e.g., the ground as in FIG. 1, or steps as in FIG. 2. In this position, hoop feet 40 bear on swivel feet 30. Moreover, because of the elongated slots 38, the feet can be swiveled up to a position alongside the side edges of leg assemblies 22 as shown in FIG. 18, to enable the teeth 30*a*** at the inner ends of the feet to dig into the underlying support surface S.

Figure 4:
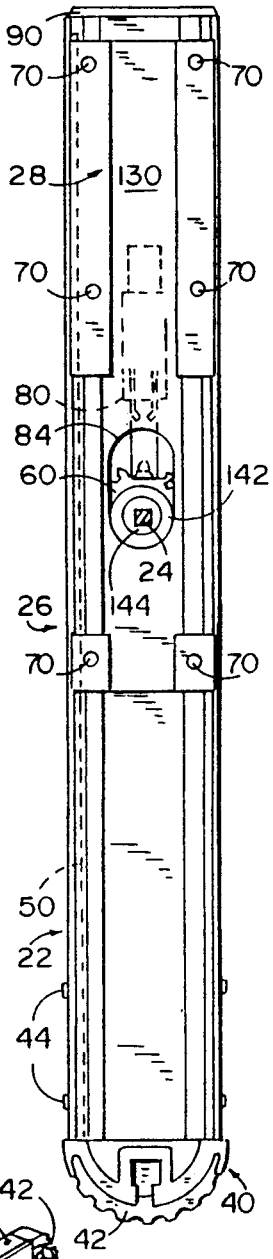
FIG. 4 is a side elevational view of one leg assembly of the leveler attachment.

Each of the leg assemblies e.g., 22 includes an outer leg housing 26, a base plate 28, a gear rack 50, a spur gear 60, a plurality of T-head bolts 70, a gear lock 80 (FIG. 5), and an upper end cap 90 (FIG. 4).

Figure 10:
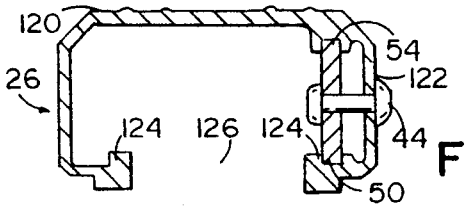
FIG. 10 is a sectional view through the leg housing, showing the gear rack.
Figure 11:
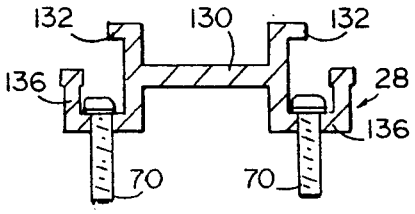
FIG. 11 is a sectional view through the base plate which interfits with the leg housing in FIG. 10.

Leg housing 26 comprises an elongated member, preferably of extruded aluminum, having a closed outside wall 120 integrally joined with a pair of edge walls 122 (FIG. 10), the inside wall being partially open and defining a pair of elongated slide tracks 124 adjacent and straddling the elongated opening 126. Mounted within housing 26, near one edge wall of housing 26, is elongated gear rack 50 secured to the housing by rivets 44. It is in the form of a flat stamping having evenly spaced openings 150. These openings terminate short of one elongated solid end portion 152 through which rivets 44 extend. These same rivets 44 that secure the hoop foot also secure the gear rack. The opposite solid end of the gear rack also has openings 150 which terminate short of the end so that there is a stop surface 154 beyond which the gear cannot move. This stop surface 154 prevents the gear from releasing from the rack inadvertently. Gear rack 50 is spaced from the adjacent wall 122 by being positioned in a pair of oppositely positioned, facing grooves 54. This spaced relationship between rack 50 and wall 122 allows teeth of gear 60 to fit through openings of the gear rack. Gear 60 can move along the fixed gear rack by rotating, in a fashion to be described hereinafter.

Figure 12:
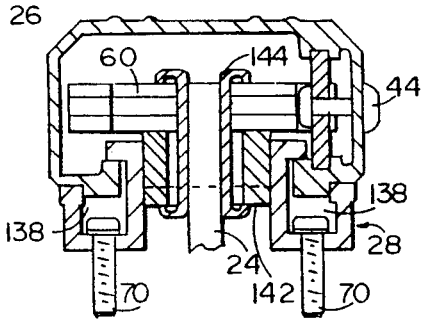
FIG. 12 is a sectional view through the leg assembly taken on plane XII—XII of FIG. 9.
Figure 13:
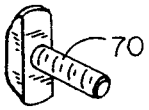
FIG. 13 is a perspective view of one of the T-head bolts in the assembly.

Base plate 28 is also preferably formed of an elongated piece of extruded aluminum or the like, having a central web 130 integral with a pair of slide tracks 132 which engage rails 124 of housing 26, in the manner indicated in FIG. 12. These two components 26 and 28 are longitudinally slidably interconnected. Also extending from web 130 is a pair of generally U-shaped, elongated, integral abutment portions 136, the outer distal ends of which engage the outer surfaces of housing 26 to be in slidable relationship therewith and interlock the housing and base plate in sliding relationship, and to define a pair of elongated pockets 138 which receive the heads of T-head bolts 70 (FIG. 12) to retain the bolts in position. The pockets into which the heads fit are narrower than the width of the longest dimension of the T-heads, to prevent rotation of the bolts, i.e., form a loose interference fit. These elongated pockets also eliminate the need for washers, etc. when attaching the leveler to a ladder. This greatly simplifies assembly of the leveler to a ladder. The heads of bolts 70 have a greater dimension in one direction than in the direction normal thereto. The threaded part of each bolt 70 extends through a hole in base plate 28 to protrude therefrom. Base plate 28 has a vertically elongated slot opening 131 in web 130 adjacent the hub of gear 60, of a width to accommodate bushing 142 (FIG. 9). On opposite sides of this slot, elongated portions 136 are cut away to form a recess at 137 (FIG. 9). This recess provides a spacing so that the conventional, swedged-over outer ends of the ladder rungs that protrude beyond the outer face of the ladder rails can be accommodated by the leveler legs, i.e., to enable the base plate to fit flat against the outer wall surface of the ladder side rail rather than rocking over the swedge protrusions normally found on the ladder.

Figure 8:
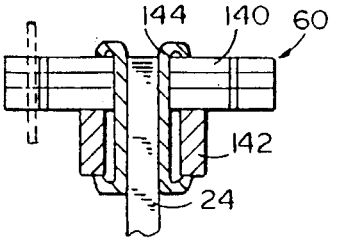
FIG. 8 is a plan, partially sectioned view through FIG. 7 taken on plane VIII—VIII.
Figure 6:
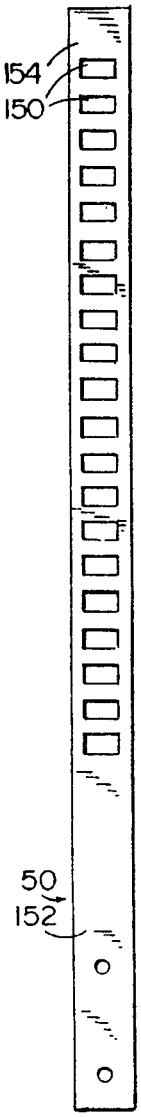
FIG. 6 is an elevational view of a gear rack from the leg assembly.

Spur gear 60 is formed by placing a plurality of, here shown to be three, stamped gear-shaped plates 140 (FIG. 8) into a stacked relationship, each plate having a central passage therethrough and a plurality of peripheral teeth. A bushing 142 is placed in axial relationship adjacent the outer face of one end plate. A sleeve or tube 144 extends through the plates and the bushing. This sleeve has its ends axially inwardly and radially outwardly swedged so that one end of the sleeve is swedged against one outer plate (FIGS. 8 and 12) and the other end is swedged against the axial end of bushing 142 (FIGS. 8 and 12). This sleeve has a cylindrical outer periphery, and an inner periphery which is polygonal in cross section, here shown to be square, to slidably receive a like configurated, i.e., square in cross section, polygonal drive rod 24. The cylindrical outer periphery serves as an abutment stop surface to limit the extent to which drive rod 24 can be inserted into the sleeve and thus into the gear. Therefore, the rod is assured of being in full engagement with the gear on both ends of the rod.

Figure 16:
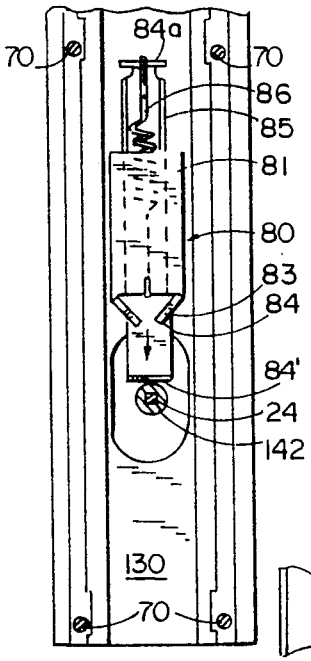
FIG. 16 is a side elevational view of the inside of the base plate, showing the gear lock thereon.

Secured to the inside surface of web 130 of base plate 28, so as to be enclosed between the base plate and housing 26, is gear lock 80 which has downwardly inwardly extending legs 82 which converge toward each other and terminate in spaced relationship to each other to interengage with one tooth, or between the teeth, of gear 60. Slidably movable within the fixed body 81 is a biasing projection 84 with a bottom flange 84' engageable with bushing 142 when the gear and bushing move upwardly in slot 131. This projection 84 is biased downwardly relative to body 81 by a tension coil spring 86 (FIG. 16) secured between the upper end **84*a* of slide 84 and body 81**.

When it is desired to mount the two preassembled leg assemblies to a conventional ladder, a plurality of six holes are drilled in each side rail 12 of the ladder, preferably using a template, and a hole is drilled in each side rail in alignment with the center of lowermost hollow rung 14'. The T-head studs 70 of one leg assembly are then inserted through the drilled holes in one side rail. The threaded studs protruding from the inside of the rail are secured with nuts, and a reinforcing plate 160 (FIG. 1) beneath the nuts, for each pair of studs 70. Drive rod 24 is then cut to length so that its ends will extend through side rails 12 and into engagement with gears 60. The other side rail is then drilled in the same manner as the first, and the drive rod is inserted through the second rail, the hollow rung 14' and the first rail into gear 60 of the first leg assembly. The second extension leg assembly is then mounted on the second side rail by inserting studs 70, causing the drive rod to engage the second gear, and attaching reinforcement plates 160 and suitable nuts thereon. With these few simple steps, the unit is ready to be used.

When the ladder is placed on an uneven surface or on steps, or some other situation where one leg should be lower than the other in order to cause the ladder to remain true vertical, the leg that first engages the surface will move up due to the upward pressure on the one leg, causing gear 60 to move )lp along rack 50. Drive rod 24 will rotate with gear 60, causing the second gear 60 to rotate in the same angular direction. Since the gear rack of the second leg is in mirror image relation to the first, this will cause downward movement of the second leg housing until both feet engage the support surface. At this point, the gears cannot move further and, for safety purposes, gear locks 80 will move downwardly under the weight of the ladder and the person, against the bias of spring 86, to engage teeth of gears 60 and secure them in nonrotative position.

It is intended that the invention is to be limited only by the scope of the appended claims and the reasonably equivalent structures thereto rather than to the preferred embodiment depicted and described as illustrative.

The embodiments of the invention in which an exclusive property or privilege is claimed are defined as follows.

1. A ladder leveler attachment for attachment to the side rails of a ladder, comprising:

a pair of preassembled leg assemblies;

each said assembly also including an elongated, hollow leg housing having an open inner side wall, and an elongated base plate slidably interfitted with said housing;

attachment means protruding from said base plate for attaching each said leg assembly to a ladder side rail;

said elongated housing and said elongated base plate having interfitting slide tracks therebetween to enable sliding movement relative to each other for vertical adjustment when attached to a ladder;

a drive rod for extending between and interfitting with said assemblies and having a pair of drive ends; and each said assembly including a rotational gear, a gear rack receiving and engaged with teeth of said gear, and a gear lock for locking said against rotation, each said gear having a polygonal configurated socket for slidably receiving one of said drive ends of said drive rod in rotationally fixed relationship thereto.

2. The ladder leveler attachment in claim 1 wherein said configurated socket in each said gear has an outer end abutment stop surface to limit the extent of insertion of said drive rod therein.

3. The ladder leveler attachment in claim 2 wherein each said gear is formed of a plurality of plates and includes a sleeve through said plates and forming said polygonal configurated socket, said sleeves being swedged on the ends thereof, and said abutment stop surfaces being of different configuration than said polygonal configuration.

4. The ladder leveler attachment in claim 1 wherein said attachment means comprises bolts having heads, said base plate having pockets receiving said bolt heads of said bolts and fixing said bolts against rotation, and retaining means for retaining said bolts in said pockets.

5. The ladder leveler attachment in claim 4 wherein said bolt heads are elongated and form a loose interference fit with said pockets, eliminating the need for washers.

6. The ladder leveler attachment in claim 1 wherein said elongated base plate has a recess adjacent said drive rod to receive and fit over conventional protruding swedged ends of a rung of a ladder.

7. The ladder leveler attachment in claim 4 wherein said retaining means for retaining said bolts in said pockets comprises surfaces of said housing.

8. The ladder leveler attachment in claim 1 wherein each said housing has a surface-engaging hoop foot comprising a metal support and a polymeric pad.

9. The ladder leveler attachment in claim 8 wherein each said hoop foot has an elongated opening therethrough of polygonal cross sectional configuration, to receive an elongated fastener for attachment of a spur or a swivel foot thereto.

10. The ladder leveler attachment in claim 9 including a spur attached to each said hoop foot by an elongated fastener, said fastener having a polygonal portion matching said elongated opening configuration to prevent rotation therein, and said spur has a polygonal opening matching said fastener portion to prevent rotation of said spur.

11. The ladder leveler attachment in claim 8 wherein said metal support has a passage for receiving a fastener, and including a swivel foot removably secured to said metal support by a fastener.

12. The ladder leveler attachment in claim 9 wherein each said swivel foot has a shoe, an upstanding support and a polymeric pad on the bottom of said shoe, said support having slotted recesses to receive the fastener, and said swivel foot and said slotted recesses being configurated to allow said swivel foot to be swiveled between an edge engaging, generally vertical, support position alongside said housing, and a bottom engaging, generally horizontal, support position beneath said housing.

13. The ladder leveler attachment in claim 12 wherein said slot is dogleg-shaped.

14. The ladder leveler attachment in claim 1 wherein said gears each are formed of a plurality of stampings and a sleeve therethrough, said sleeve being axially swedged against said stampings.

15. The ladder leveler attachment in claim 14 including a bushing axially aligned with and abutting said gear stampings, and secured to said stampings by said sleeve.

16. The ladder leveler attachment in claim 15 wherein said sleeve has a different configuration in a portion thereof to form an abutment stop surface for said drive rod to thereby limit the extent of insertion of said rod therein.

17. The ladder leveler attachment in claim 1 wherein said racks each have closed ends forming stops for said gears.

18. A ladder leveler attachment for mounting on the side rails of an existing ladder, comprising:

a pair of preassembled leg assemblies and a removable drive rod to extend between said assemblies;

each said leg assembly comprising an elongated housing and an elongated base plate slidably interengaged to move in one dimension longitudinally relative to each other, and interengaged against movement in other dimensions;

a gear and a gear rack in each said housing;

said drive rod slidably engaging said gears at its ends;

each said leg assembly having rotationally fixed studs extending laterally of said base plate, normal to said longitudinal dimension, for extending through orifices in the ladder side rails, whereby said leg assemblies can be mounted to the side rails in mirror image to each other.

19. The ladder leveler attachment in claim 18 wherein said studs comprise bolts with heads which are fixed against rotation by an interference fit with said base plate.

20. The ladder leveler attachment in claim 19 wherein said bolts are retained in said pockets by said housing.

* * * * *

UNITED STATES PATENT AND TRADEMARK OFFICE

CERTIFICATE OF CORRECTION

PATENT NO. : 5,273,133
DATED : December 28, 1993
INVENTOR(S) : Quinton F. Thocher et al.

It is certified that error appears in the above-indentified patent and that said Letters Patent is hereby corrected as shown below:

column 3, line 26: "33'" should be --31'--;

column 5, line 45: "move )lp" should be --move up--;

column 6, line 15: after "said" insert --gear--.

Signed and Sealed this

Nineteenth Day of July, 1994

*Attest:*

*Attesting Officer*

BRUCE LEHMAN

*Commissioner of Patents and Trademarks*